United States Patent [19]

Neuer

[11] Patent Number: 4,897,114

[45] Date of Patent: Jan. 30, 1990

[54] NITROGEN-CONTAINING ADDITIVE FOR STEEL MELTS

[75] Inventor: Bernd Neuer, Schnaitsee, Fed. Rep. of Germany

[73] Assignee: SKW Trostberg Aktiengesellschaft, Trostberg, Fed. Rep. of Germany

[21] Appl. No.: 270,749

[22] Filed: Nov. 14, 1988

[30] Foreign Application Priority Data

Nov. 19, 1987 [DE] Fed. Rep. of Germany ..... 3739156

[51] Int. Cl.[4] ..... C21C 7/02

[52] U.S. Cl. ..... 75/53; 75/58

[58] Field of Search ..... 75/53, 58

[56] References Cited

U.S. PATENT DOCUMENTS

| | | | |
|---|---|---|---|
| 3,322,530 | 5/1967 | Nakamura | 75/51.7 |
| 3,551,139 | 12/1970 | Schokkenbroek | 75/53 |
| 4,078,915 | 3/1978 | Meichsner | 75/53 |
| 4,159,906 | 7/1979 | Meichsner | 75/53 |
| 4,236,914 | 12/1980 | Kitamura | 75/53 |
| 4,765,599 | 8/1899 | Ferrari | 75/53 |

FOREIGN PATENT DOCUMENTS

| | | |
|---|---|---|
| 0123632 | 10/1984 | European Pat. Off. . |
| 1225215 | 9/1966 | Fed. Rep. of Germany . |
| 1007051 | 10/1965 | United Kingdom . |

OTHER PUBLICATIONS

Steel Times, Nr. 5, Mai 1986, Seiten 242 u. 259, Redhill; Uday K. Sinha: "Ladle injection for deoxidation and microalloying".

*Primary Examiner*—Peter D. Rosenberg
*Attorney, Agent, or Firm*—Felfe & Lynch

[57] ABSTRACT

The present invention provides a nitrogen-containing additive for steel melts based on calcium cyanamide, wherein it is in the form of a cored wire consisting of a metallic sheath and finely-divided calcium cyanamide as filling material.

13 Claims, No Drawings

NITROGEN-CONTAINING ADDITIVE FOR STEEL MELTS

The present invention is concerned with a nitrogen-containing additive for steel melts based on calcium cyanamide.

As is known, nitrogen is today used as alloying element in a large number of steel qualities for the improvement of the material properties, especially of the strength and toughness.

For this purpose, alloying is carried out with gaseous nitrogen which is passed into molten steel or nitrogen-containing alloys or compounds are added to the steel melts.

In practice, nitriding with gaseous nitrogen is only possible when small nitrogen concentrations are required but the accuracy is, however, unsatisfactory. Furthermore, the great expenditure of time and also the temperature losses of the melts are very disadvantageous.

In order to avoid these problems, nitrogen-containing compounds or alloys are usually employed.

Usual alloys are hereby nitrided ferromanganese or ferrochromium with low nitrogen contents of 4 to 6%. It is possible to alloy with these relatively accurately but the amounts of nitrogen which can be introduced into the steel melts are very frequently limited by the manganese or chromium contents of the steel analysis. Furthermore, as nitriding agents, these alloys are comparatively expensive.

Calcium cyanamide is also known as an economic nitriding agent for nitrogen-alloyed steel in the steel industry, the calcium cyanamide being introduced into the ladles in sacks or buckets during tapping. However, this process suffers from very serious disadvantages. With a total carbon content of about 20%, the calcium cyanamide introduces considerable amounts of carbon into the steel melt which is taken up almost 100% by the steel.

Since, in the case of this process, the nitrogen recovery only amounts to about 30%, the increase of the amount of carbon which takes place automatically can be prohibitive for the use of calcium cyanamide, especially in the case of low carburised steels, for example in the case of 18/8 stainless qualities.

A further disadvantage of this method of addition are the great variations of the nitrogen recovery in the case of the addition of the calcium cyanamide during tapping or also into the flushing spot. Because calcium cyanamide has a low specific weight, it floats up and decomposes on the surface of the bath. The final analysis cannot be safely adjusted with the usual addition technique so that a corrective addition is usually necessary.

The problems explained with regard to calcium cyanamide are due not insubstantially to the fact that calcium cyanamide is not stable and, in the case of comparatively long storage, disintegrates into fine granules and thus, depending upon the period of storage, contains ever differing proportions of fines. These fine parts are then, in the case of conventional addition, carried away by the rising hot air as a result of which low and variable recoveries of the calcium cyanamide come about.

Therefore, it is an object of the present invention to provide a nitrogen-containing additive based on calcium cyanamide which does not display the mentioned disadvantages of the prior art but rather makes possible a substantially higher and more uniform nitrogen recovery.

Thus, according to the present invention, there is provided a nitrogen-containing additive for steel melts based on calcium cyanamide, wherein it is in the form of a cored wire consisting of a metallic sheath and finely-divided calcium cyanamide as filling material.

Surprisingly, we have found that in this way all the substantial problems of the prior art are overcome and a definite and uniform output with unexpectedly high yields is possible although the calcium cyanamide used is also present in finely-divided form.

The nitrogen-containing additive according to the present invention is present in the form of a cored wire consisting of a metallic sheath with finely-divided calcium cyanamide as filling material, which is enclosed by the sheath.

The diameter of the whole cored wire can vary within wide limits but, in practice, a diameter range of 5 to 20 mm. and preferably of 9 to 13 mm. has proved to be especially advantageous.

The filling material of the wire consists of technique calcium cyanamide (nitrogen content 20 to 26%) which is to be present in a form which is as finely-divided as possible in order to make possible a substantially uniform distribution of the treatment agent in the steel melt. Therefore, the particle size of the calcium cyanamide used should preferably be smaller than 1 mm.

The amount of calcium cyanamide used per unit length of cored wire depends essentially upon the diameter of the cored wire and, as a rule, is from 50 to 250 g. of calcium cyanamide per meter of cored wire.

The sheath material should be so chosen that it dissolves relatively quickly in the steel melt with liberation of the treatment agent without this sheath material or residues thereof introducing undesired components into the steel melt. In practice, non-alloyed steel coverings have hereby proved to be especially useful. As a rule, the thickness of the sheath is from 0.1 to 1 mm. and preferably from 0.2 to 0.6 mm.

The production of the additive according to the present invention is free of problems and takes place according to conventional processes and methods.

The calcium cyanamide, possibly after comminution thereof to the desired grain size range, is filled into the wires which are subsequently closed by folding down or welding and wound up on to coils.

The steel treatment with the additive according to the present invention can be carried out safely and without problems. Depending upon the desired nitrogen analysis, which is usually from 100 to 1000 ppm, there are used 0.1 to 10 kg. of cored wire per tonne of steel to be treated, spooling in rates of 50 to 180 m./minute and especially of 100 to 150 m./minute thereby having proved to be suitable. The cored wire is preferably injected into the steel melt at a depth of from 1 to 1.5 m.

Under these conditions, even very finely-divided calcium cyanamide decomposes in the steel melt so that the nitrogen is liberated in the lower layers of the bath and goes into solution.

In this way, it is ensured that a definite and high nitrogen recovery of 90 to 95% is achieved. Furthermore, the required end analysis of the steel can thereby be achieved certainly and precisely so that time-consuming post-corrections are unnecessary. Because of the good output, the problem of carbon take up is also solved substantially.

The following Examples are given for the purpose of illustrating the present invention:

EXAMPLE 1

80 tones of steel melt with the following analysis:
C=0.18%
Si=0.22%
Mn=1.34% with an initial content of 68 ppm [N] is to be nitrided up to a content of 180 to 220 ppm [N]. For this purpose, into the batch is injected 270 m. of a 13 mm. wire, consisting of a non-alloyed steel sheath (thickness 0.4 mm.), as well as 178 g. of finely-divided technical calcium cyanamide (nitrogen content 23.5%) (particle size <1 mm.) per meter of cored wire, at a rate of 150 m./minutes. The end nitrogen content was analysed as being 198 ppm, which corresponds to a nitrogen output of 91.5%.

EXAMPLE 2

An 80 tonne batch of a steel melt with an 18/8 stainless quality is to be nitrided from 240 ppm [N] to 500 to 600 ppm [N].

For this purpose, 560 m. of a cored wire corresponding to Example 1 is injected into the steel melt at a rate of 150 m./minute.

The nitrogen content was 520 ppm, which corresponded to a nitrogen output of 95%. The carbon take up was merely 0.02%.

We claim:

1. A device for nitriding molten steel, comprising a continuous, substantially cylindrical metallic sheath which is quickly soluble in molten steel, said metallic sheath defining a continuous hollow space therein, said space being filled with finely divided calcium cyanamide.

2. A device of claim 1, wherein the metallic sheath has a diameter of 5 to 20 mm.

3. A device of claim 1, wherein the metallic sheath has a diameter of 9 to 13 mm.

4. A device of claim 1, wherein the calcium cyanamide has a particle size of less than 1 mm.

5. A device of claim 1, wherein the metallic sheath contains 50 to 250 g of calcium cyanamide per meter.

6. A device of claim 1, wherein the metallic sheath consists of non-alloyed steel.

7. A device of claim 1, wherein the metallic sheath has a thickness of 0.1 to 1 mm.

8. A device of claim 7, wherein the metallic sheath has a thickness of 0.2 to 0.6 mm.

9. The method of nitriding molten steel which comprises gradually introducing into the molten steel a continuous hollow, substantially cylindrical metallic sheath which is quickly soluble in molten steel and filled with finely divided calcium cyanamide.

10. The method of claim 8, wherein the metallic sheath filled with calcium cyanamide is introduced into the molten steel at a weight rate of 0.1 to 10 kg per ton of molten steel.

11. The method of claim 8, wherein the metallic sheath filled with calcium cyanamide is introduced into the molten steel at a linear rate of 50 to 180 meters per minute.

12. The method of claim 11, wherein the metallic sheath filled with calcium cyanamide is introduced into the molten steel at a linear rate of 100 to 150 meters per minute.

13. The method of claim 9, wherein the metallic sheath filled with calcium cyanamide is introduced into the molten steel at a point 1 to 1.5 meters below the surface of the molten steel.

* * * * *